US009325058B2

(12) United States Patent
Le

(10) Patent No.: US 9,325,058 B2
(45) Date of Patent: Apr. 26, 2016

(54) BROADBAND AIRCRAFT WINGTIP ANTENNA SYSTEM

(71) Applicant: Intel Corporation, Santa Clara, CA (US)

(72) Inventor: Kevin Le, Los Angeles, CA (US)

(73) Assignee: Intel Corporation, Santa Clara, CA (US)

( * ) Notice: Subject to any disclaimer, the term of this patent is extended or adjusted under 35 U.S.C. 154(b) by 264 days.

(21) Appl. No.: 13/945,419

(22) Filed: Jul. 18, 2013

(65) Prior Publication Data

US 2014/0159965 A1 Jun. 12, 2014

Related U.S. Application Data

(60) Provisional application No. 61/673,004, filed on Jul. 18, 2012.

(51) Int. Cl.
*H01Q 1/28* (2006.01)

(52) U.S. Cl.
CPC ..... *H01Q 1/283* (2013.01); *H01Q 1/28* (2013.01); *H01Q 1/287* (2013.01)

(58) Field of Classification Search
CPC ..... H01Q 1/283; H01Q 1/287; H01Q 1/28
See application file for complete search history.

(56) References Cited

U.S. PATENT DOCUMENTS

| | | | |
|---|---|---|---|
| 3,774,220 | A | 11/1973 | Martin et al. |
| 5,825,332 | A | 10/1998 | Camacho et al. |
| 6,097,343 | A | 8/2000 | Goetz et al. |
| 7,182,297 | B2 | 2/2007 | Jackson |
| 7,624,951 | B1 | 12/2009 | Kraft et al. |
| 2005/0237260 | A1 | 10/2005 | Bancroft |
| 2008/0210822 | A1 | 9/2008 | Hanusa et al. |
| 2009/0237314 | A1 | 9/2009 | Lalezari |
| 2012/0098714 | A1 | 4/2012 | Lin et al. |

FOREIGN PATENT DOCUMENTS

| | | |
|---|---|---|
| WO | 2011/063273 | 5/2011 |
| WO | WO2014/015127 A1 | 1/2014 |

OTHER PUBLICATIONS

International Search Report and Written Opinion in corresponding PCT application No. PCT/US2013/051060, Nov. 14, 2013, 9 pp.
"International Application Serial No. PCT/US2013/051060, International Preliminary Report on Patentability mailed Jan. 29, 2015", 7 pgs.

*Primary Examiner* — Hoang V Nguyen
*Assistant Examiner* — Michael Bouizza
(74) *Attorney, Agent, or Firm* — Schwegman Lundberg & Woessner, P.A.

(57) ABSTRACT

An isotropic antenna system internally mounted in the outermost portion of an aircraft wing and in the elevated winglet or similar vertical member of an aircraft wing. The antenna includes a shaped dielectric substrate including a horizontally oriented section located in the horizontally oriented member of the aircraft wing, a vertically oriented section located in the vertically oriented member of the aircraft wing, a first antenna element on the top surface of the dielectric substrate in the vertically oriented member of the aircraft wing, a second antenna element on the top surface and the bottom surface of the dielectric substrate, an antenna feed point coupled to the first antenna element and to the second antenna element, and a Radio Frequency (RF) energy guide coupled to the second antenna element. When the antenna is implemented and installed it does not substantially alter the appearance or aerodynamic characteristics of the aircraft.

7 Claims, 5 Drawing Sheets

BROADBAND AIRCRAFT WINGTIP ANTENNA SYSTEM

CROSS REFERENCE TO RELATED APPLICATION

This application is a nonprovisional and claims the priority benefit of U.S. provisional application Ser. No. 61/673,004, filed Jul. 18, 2012, entitled BROADBAND AIRCRAFT WINGTIP ANTENNA SYSTEM of the same inventor and owned by a common assignee. The content of that provisional application is incorporated herein by reference.

FIELD OF INVENTION

The present invention relates to airborne wireless communications systems. More specifically, the present invention relates to a fixed wing, winglet mounted broadband antenna system.

BACKGROUND OF THE INVENTION

Prior art aircraft antennas are well known starting from the beginning of the early days of aviation and have been installed within or on the exterior surfaces of the aircraft. However, current art aircraft communication radios have to cope with a co-location interference problem when multiple antennas are transmitting and receiving concurrently, primarily due to their location in the aircraft fuselage. When additional communication radios and antennas (i.e. services) are added to the aircraft extensive coupling analysis are required, and subsequent relocation of existing antennas may be required to mitigate harmful interference. Furthermore, installation of new antennas can potentially alter the cosmetic appearance of the aircraft, or can alter or degrade the aerodynamic characteristics of the aircraft. As the number of antennas increases, reduced spacing with consequential reduction of electrical isolation therebetween must be dealt with. In the present state of the art broadband antenna, with generally isotropic radiation pattern from High Frequency (HF) band (30 MHz) to Very High Frequency (VHF) band (500 MHz) is installed in the port side winglet of a fixed wing aircraft.

SUMMARY OF THE INVENTION

The system described herein is an isotropic antenna system internally mounted in the outermost portion of an aircraft wing and in the elevated winglet or similar vertical member of an aircraft wing. As will be described below, the winglet antenna can be implemented using internally mounted shaped dielectric structure within the non-conductive trailing edge of the winglet. When the antenna is implemented and installed it does not substantially alter the appearance or aerodynamic characteristics of the aircraft. In addition, other features and variations could be implemented, if desired.

The antenna system includes a shaped dielectric substrate including a horizontally oriented section located in the horizontally oriented member of the aircraft wing, a vertically oriented section located in the vertically oriented member of the aircraft wing, a top surface and a bottom surface, a first antenna element on the top surface of the dielectric substrate in the vertically oriented member of the aircraft wing, the first antenna element having a first end and a second end, a second antenna element on the top surface and the bottom surface of the dielectric substrate, the second antenna element having a first end and a second end, an antenna feed point coupled to the first end of the first antenna element and to the second end of the second antenna element and a Radio Frequency (RF) energy guide coupled to the second end of the second antenna element. It may include a feed balun coupled to the second antenna element.

The antenna system of the present invention can be implemented in the vertical and horizontal members of an aircraft wing and provide broadband coverage with limited or no interference with other equipment and is configured of one or more shapeable material that have little or no impact on the aircraft's aerodynamics. These and other advantages of the invention will become apparent to those of skill in the art upon review of the following detailed description, the accompanying drawings and the appended claims.

DETAILED DESCRIPTION OF THE INVENTION

The present invention is a broadband antenna system 12 for a fixed wing aircraft. It is capable of providing for a generally isotropic radiation pattern from High Frequency (HF) band (30 MHz) to Very High Frequency (VHF) band (500 MHz) but not limited thereto. Details of certain embodiments of the invention are set forth in the following description and in accompanying FIGS. 1-5 to provide an adequate understanding of these embodiments. One skilled in the art, however, will understand that the present invention may have additional embodiments, and that the invention may be practiced without several of the details described below.

Figure 1:
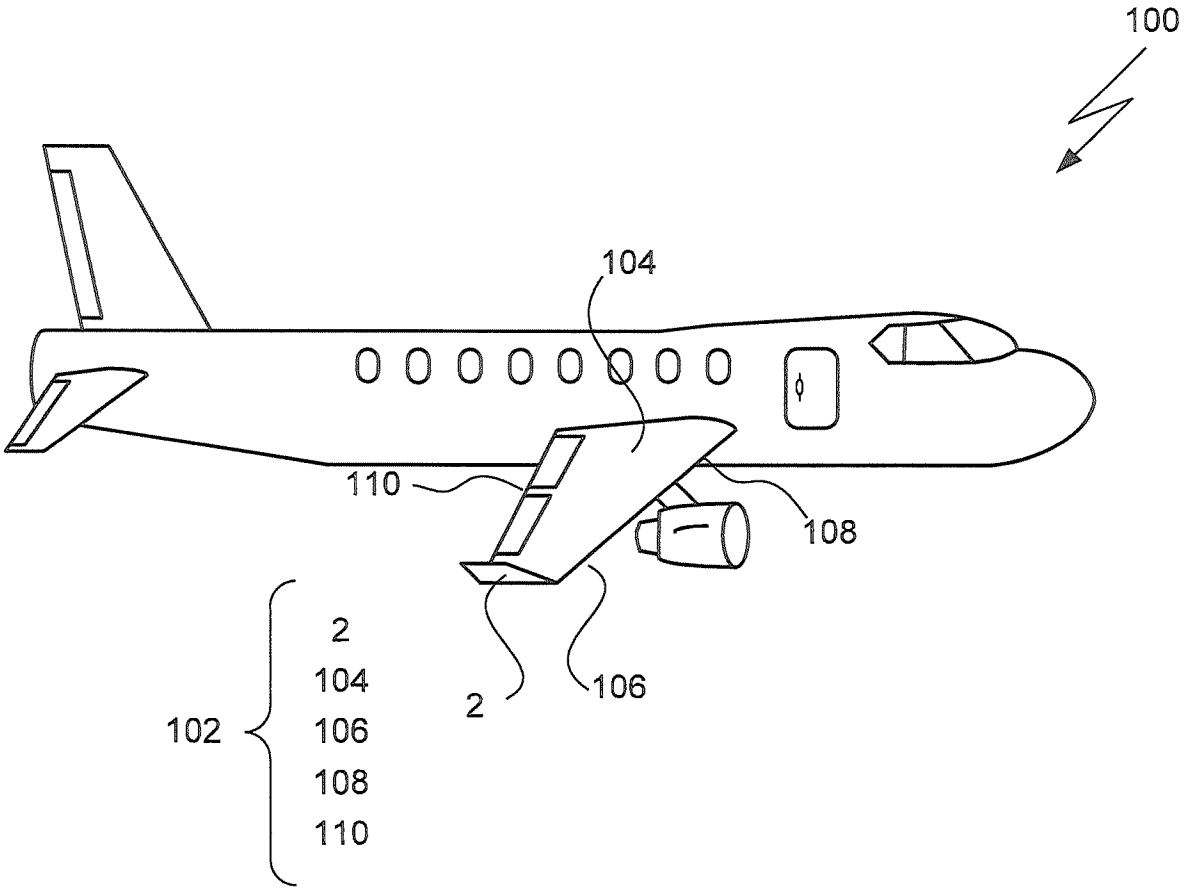
FIG. 1 is a starboard (right) side view of fixed wing aircraft configured with winglets.

FIG. 1 is a right side view general illustration of a fixed wing aircraft 100. In one aspect of an embodiment of the invention shown in FIG. 1, the wing 102 of the aircraft 100 can include an upper surface 104, a lower surface 106, a leading edge 108, and a trailing edge 110. Even though right side of the aircraft is shown, the left side wing of the aircraft 100 is generally constructed identically (or mirrored). In one aspect of this embodiment, the fixed wing aircraft 100 can include a fuselage, a pair of wings 102 extending outwardly from the aircraft fuselage, and propulsion engines suspended under the wings 102 to propel the aircraft 100 during flight. Each wing 102 has an essentially horizontally oriented member and can include a vertically oriented member shown in the form of a winglet 2 for lateral stability, control and improved fuel consumption.

Figure 2:
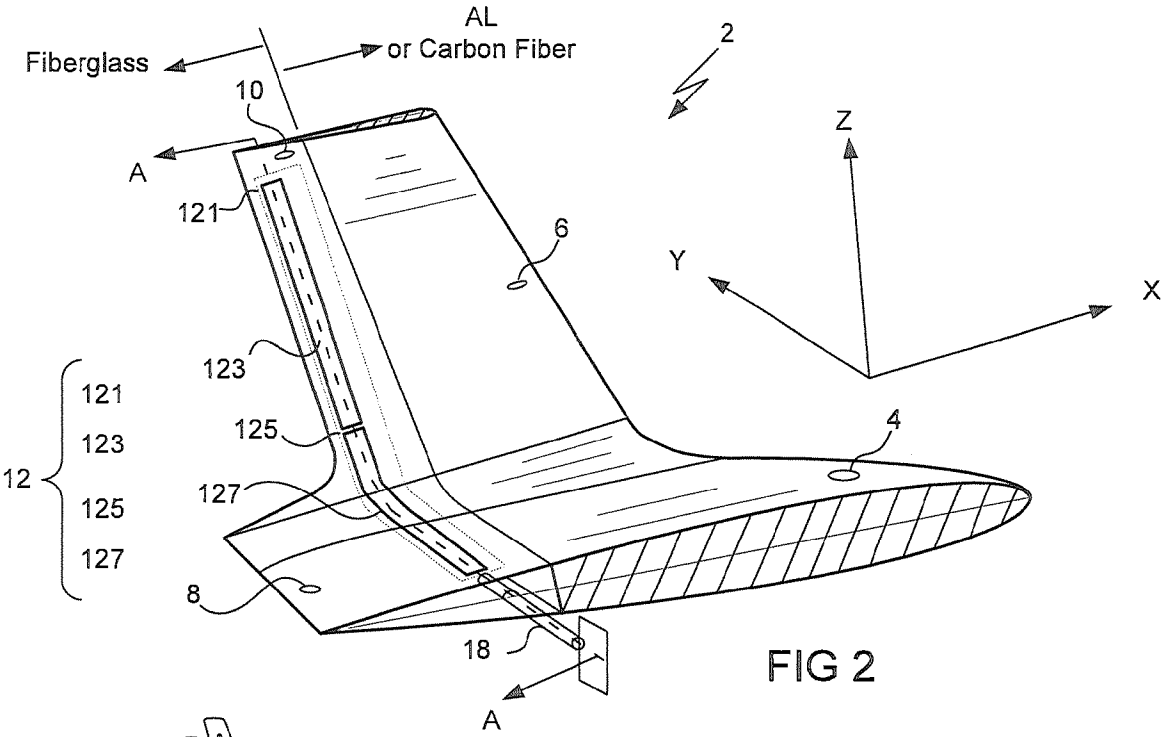
FIG. 2 is a pictorial diagram of the port side aircraft wing with vertically oriented winglet and/or similar vertical member illustrating general positioning of a broadband antenna system of the present invention.
Figure 2A:
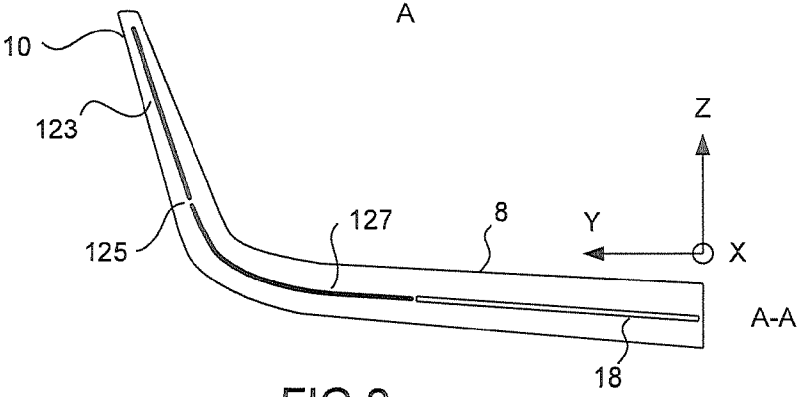
FIG. 2*a* is a cross sectional view along the antenna centerline shown in FIG. 2 as installed therein.

FIGS. 2 and 2A are partially schematic, isometric illustrations of a port (left) side composite winglet 2 of the fixed winged aircraft 100 configured with a composite material winglet assembly in accordance with an embodiment of the invention attached at the outwardly edge of the port (left) side wing. The composite winglet 2 is constructed to match the contours of the wing such that the corresponding surfaces seamlessly transition from the wing's vertically oriented portion to its horizontally oriented portion. A horizontal leading edge portion 4 of the wing may be constructed from the same material used in the overall wing construction. Design provisions are made to attach winglet 2 to the wing so as to provide seamless overall functionality as required by airworthiness directives and certification requirements.

The wing may be constructed from aluminum alloys and/or carbon fiber materials. A vertically oriented leading edge portion 6 of the winglet 2 can be equally constructed from aluminum alloys and/or carbon fiber material. Such construction allows winglet structural integrity, especially when retrofitted into non-winglet equipped wings. Unlike leading edges 4 and 6 of the winglet 2, horizontally oriented trailing edge 8 and vertically oriented trailing edge 10 of the winglet 2 may be fabricated of a nonmetallic material, such as fiberglass. Fiberglass use allows placement of antenna system 12 within trailing edge portions 8 and 10 of the winglet 2 without encumbering or adversely affecting antenna system 12 radiation patterns. In an embodiment of the invention, antenna system 12 includes a shaped flexible dielectric material substrate 121 with vertically oriented antenna element 123 and antenna element 127 etched from conductive material laminated onto top surface 121*t* and bottom surface 121*b* of the dielectric substrate 121. Radio frequency (RF) signals are coupled and routed from an antenna feed point 125 via a suitable RF energy guide such as a coaxial cable 18 but not limited thereto. FIG. 2*a* shows a cross sectional illustration of the winglet 2 along plane A-A. Antenna elements 123 and 127 of the antenna system 12 can be seen relative to the trailing edge portions 8 and 10 in that view.

Figure 3:
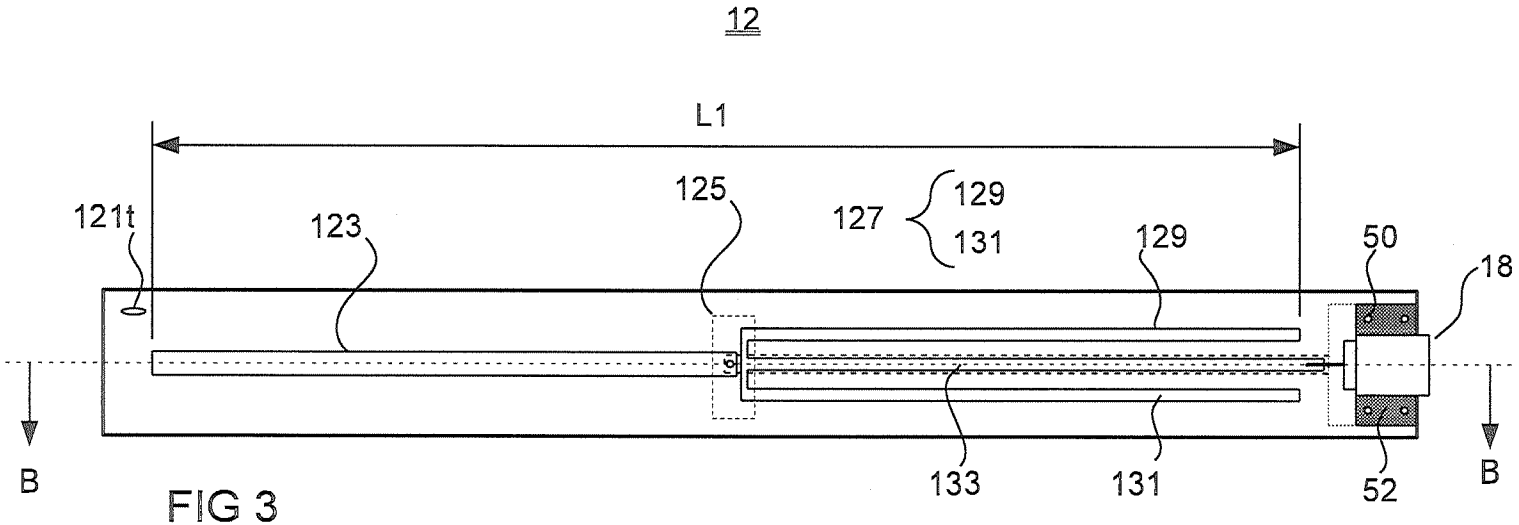
FIG. 3 is a layout diagram of the broadband winglet antenna structure of the present invention shown flat to exemplify constructional elements and the relationship therebetween.
Figure 3A:
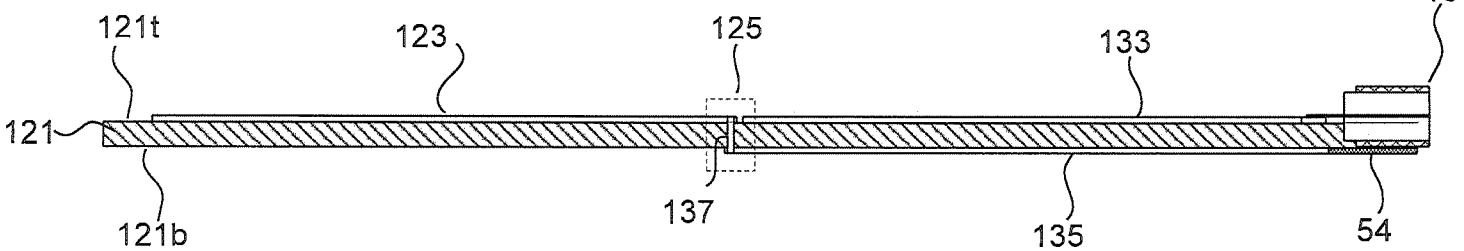
FIG. 3*a* is a cross sectional view of the antenna structure of FIG. 3.

As shown in FIGS. 3 and 3*a*, the antenna system 12 includes antenna elements 123 and 127, and a combination feed-balun including upper trace 133 and lower trace 135 on the dielectric substrate 121. In one aspect of this embodiment, the dielectric substrate 121 can include two or more conductive layers, but in simplest form is double sided; i.e., having a top portion 121*t* and a bottom portion 121*b*. It can be seen in FIGS. 3 and 4 that the antenna element 127 includes outer antenna legs 129 and 131 substantially in parallel with and connected to the upper trace 133 of the feed-balun at common contact bar 139. The upper trace 133 and the lower trace 135 are overlapping traces of a wave feed structure in the form of a planar balun as shown. The planar balun so configured may include additional sub-circuits which may enhance broadband impedance between antenna feed point 125 and characteristic impedance of the energy guide coaxial cable 18.

Figure 5:
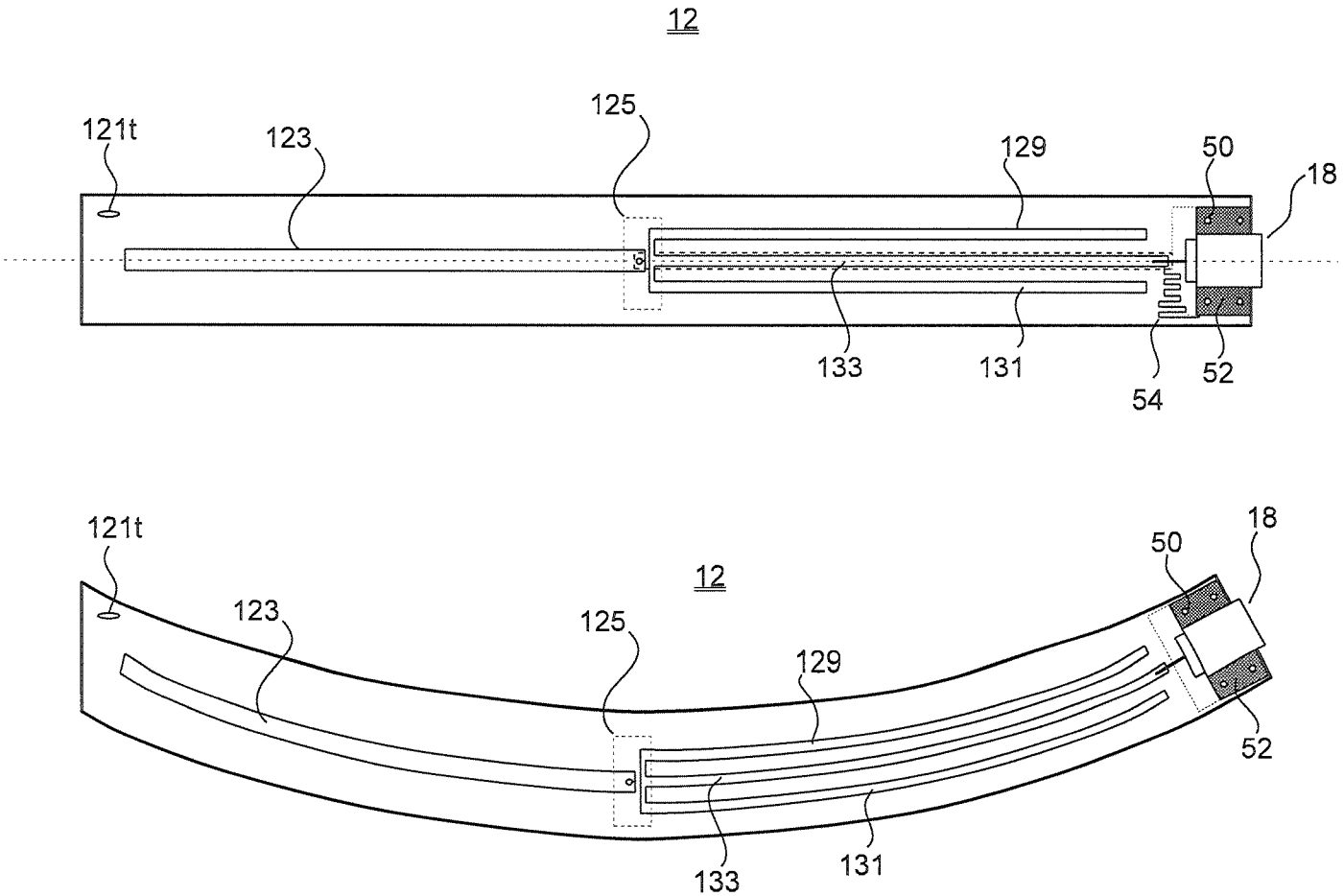
FIG. 5 is top view comparison of straight and curved shaped embodiments of the antenna system of the present invention.

Referring back to FIG. 2, the shape of the dielectric substrate 121 in that embodiment of the invention is generally rectangular; however, as shown in FIG. 5, an alternative configuration is a curved—half moon shape. Other shapes are possible as a function of the manufacture of the substrate and other associated elements of the antenna system, which may be made to accommodate complex shapes presented by the wings 102 and winglet 2.

Figure 4:
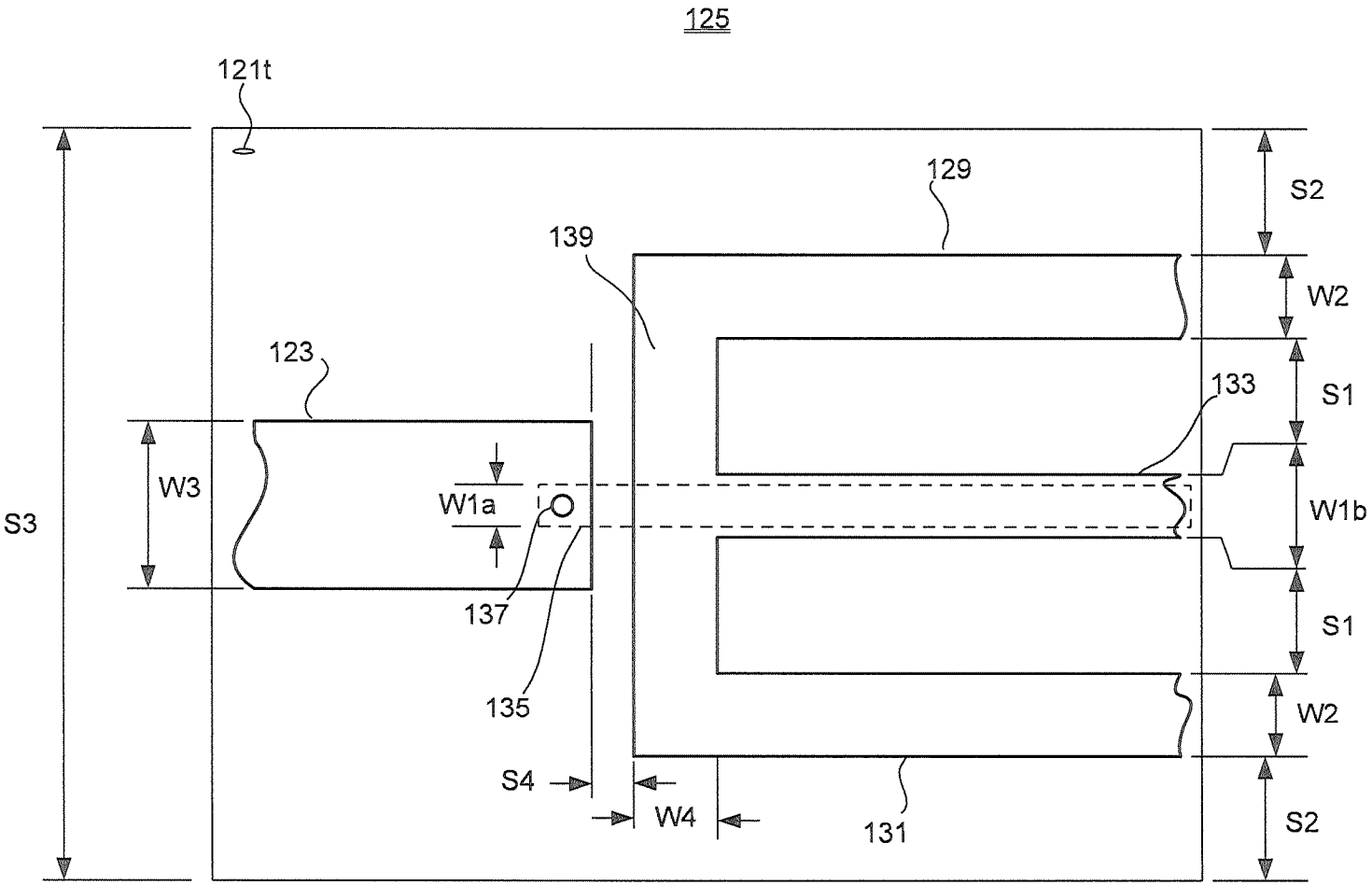
FIG. 4 is a diagram detailing the antenna feed point and the relationships of the antenna elements of the present invention.

Due to antenna system shape and positioning within the winglet structure, the RF energy guide in the form of coaxial feedline 18 can only be brought from the interior edge side of the antenna system 12 opposite from the winglet at trailing edge 10. This presents a potential concern since feed point 125 of the balun traces 133 and 135 is generally centrally located. To solve this potential concern, a centerline conductor of the coaxial feedline 18 is coupled to the upper trace 133 of the feed-balun, while the shield of the coaxial feedline 18 is coupled to upper microstrip 52 with conductive vias holes 50 and bottom microstrip 54. It should be noted that a termination interface of the coaxial feedline 18 may also have provisions for lightning protection, such as in the form of a printed inductor, represented in FIG. 3*a* as a wiggled line. One end of the lower trace 135 of the feed-balun is coupled to the bottom microstrip 54, while the other end of the lower trace 135 is coupled to a feed-through conductive via 137 which couples to first antenna element 123 disposed on the top portion 121*t* of the dielectric substrate 121. Briefly described FIG. 4 is a top view of the antenna system feed point 125 of the antenna system 12 with some of the antenna dimensions outlined in Table 1. The antenna system 12 may be manufactured using a conventional printed circuit board fabrication process well known to those with knowledge of making such systems suitable for fabrication into the complex contours associated with an aircraft wing. It includes the use of a flexible dielectric material as the dielectric substrate 121 suitable for RF antenna system manufacture and capable of withstanding environmental requirements that such system may be subjected during actual operation as part of an aircraft.

TABLE 1

| Parameter | Value | Units |
|---|---|---|
| PCB material | Stabilized FR4 | |
| Dielectric Constant (Dk) | 4.3 | |
| PCB thickness (h) | 0.030 | Inch |
| Min Frequency | 30.0 | MHz |
| Max Frequency | 500.0 | MHz |
| L1 | 43.5 | Inch |
| S1 | 1.35 | Inch |
| S2 | 0.100 | Inch |
| S3 | 4.00 | Inch |
| S4 | 0.050 | Inch |
| W1a | 0.080 | Inch |
| W1b | 0.100 | Inch |
| W2 | 0.500 | Inch |
| W3 | 2.00 | Inch |
| W4 | 0.500 | Inch |

The present invention has been described with respect to a particular embodiment or embodiments. Nevertheless, it is to be understood that various modifications may be made without departing from the spirit and scope of the invention. All equivalents are deemed to fall within the scope of this description of the invention as provided in the following claims.

What is claimed is:

1. An aircraft wing antenna system of an aircraft wing including a horizontally oriented member and a vertically oriented member, the antenna system comprising:

a. a shaped dielectric substrate including a horizontally oriented section located in the horizontally oriented member of the aircraft wing, a vertically oriented section located in the vertically oriented member of the aircraft wing, a first surface and a second surface;

b. a first antenna element on the first surface of the dielectric substrate in the vertically oriented member of the aircraft wing, the first antenna element having a first end and a second end;

c. a second antenna element on the first surface and the second surface of the dielectric substrate, the second antenna element having a first end and a second end;

d. an antenna feed comprising a conductive via hole coupled to the first end of the first antenna element and to the second end of the second antenna element;

e. a Radio Frequency (RF) energy guide coupled to the second end of the second antenna element; and f. a feed balun comprising an upper trace and a lower trace, the upper trace coupled via the RF energy guide to the second antenna element and the lower trace coupled through the conductive via hole to the first antenna element.

2. The antenna system of claim 1 wherein the upper trace of the feed balun is located between a first outer antenna leg and a second outer antenna leg of the second antenna element, the first outer antenna leg and the second outer antenna leg being parallel with the upper trace, the upper trace being coupled to the first outer antenna leg and to the second outer antenna leg with a common bar.

3. The antenna system of claim 2 wherein the RF energy guide is a coaxial feedline.

4. The antenna system of claim 3 further wherein the feed couples the first antenna element to the lower trace of the feed balun.

5. The antenna system of claim 3 wherein the coaxial feedline includes a centerline conductor and a shield, wherein the coaxial feedline is coupled to the upper trace of the feed balun and the shield is coupled to the lower trace of the feed balun.

6. The antenna system of claim 1 wherein the dielectric substrate is generally rectangularly shaped.

7. The antenna system of claim 1 wherein the dielectric substrate is generally of a curved shape.

* * * * *